US008051982B2

(12) United States Patent
McDonald

(10) Patent No.: US 8,051,982 B2
(45) Date of Patent: Nov. 8, 2011

(54) CONTAINER FOR HOLDING A STACK OF PREMOISTENED WIPES

(75) Inventor: Duane Lyle McDonald, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 940 days.

(21) Appl. No.: 11/513,914

(22) Filed: Aug. 31, 2006

(65) Prior Publication Data

US 2008/0053860 A1 Mar. 6, 2008

(51) Int. Cl.

| | |
|---|---|
| ***B65D 41/00*** | (2006.01) |
| ***B65D 43/00*** | (2006.01) |
| ***B65D 6/00*** | (2006.01) |
| ***B65D 8/04*** | (2006.01) |
| ***B65D 8/18*** | (2006.01) |
| ***B65D 85/00*** | (2006.01) |

(52) U.S. Cl. ..... 206/494; 220/254.5; 220/359.4; 220/359.5; 220/376; 220/677; 220/678; 220/810; 206/233; 206/459.5; 206/812; 215/230

(58) Field of Classification Search ..... 220/254.5, 220/359.4, 359.5, 376, 377, 677, 678, 10, 220/836, 837, 88, 810; 206/233, 459.5, 494, 206/812; 215/230

See application file for complete search history.

(56) References Cited

U.S. PATENT DOCUMENTS

| | | | | |
|---|---|---|---|---|
| 3,967,756 | A | 7/1976 | Barish | |
| 4,101,026 | A * | 7/1978 | Bonk | 206/205 |
| 4,211,396 | A | 7/1980 | Michalik et al. | |
| 4,349,345 | A | 9/1982 | Bodendoerfer | |
| 4,790,670 | A * | 12/1988 | Barbaro | 383/62 |
| 4,955,531 | A | 9/1990 | Graboyes | |
| 5,556,364 | A | 9/1996 | Konzal | |
| 5,569,143 | A | 10/1996 | Konzal | |
| 5,584,789 | A | 12/1996 | Robertson | |
| 5,620,135 | A * | 4/1997 | Stahlecker et al. | 229/198.2 |
| 5,624,367 | A | 4/1997 | Budziszewski | |
| 5,669,549 | A | 9/1997 | Robertson | |
| 5,669,550 | A | 9/1997 | Klemme et al. | |
| 5,725,382 | A * | 3/1998 | Walter et al. | 434/258 |
| 5,752,907 | A | 5/1998 | Konzal | |
| 6,076,332 | A | 6/2000 | Chick | |

(Continued)

FOREIGN PATENT DOCUMENTS

EP 0160251 A1 11/1985

(Continued)

OTHER PUBLICATIONS

PCT Search Report and Opinion for PCT/IB2007/052818 dated Jan. 10, 2008.

*Primary Examiner* — Anthony Stashick
*Assistant Examiner* — Madison L Wright
(74) *Attorney, Agent, or Firm* — Dority & Manning, P.A.

(57) ABSTRACT

A container particularly well suited to hold premoistened wipes is described. The container can be formed primarily from flat polymeric sheets. In one embodiment, for instance, the container can be formed and loaded with a stack of wipes all in a single process. Further, the flat polymeric sheets used to form the container can be printed with various graphics during formation of the container so as to apply any suitable graphics to the container. Through the process of the present disclosure, containers can be formed having a sleek and compact design.

21 Claims, 6 Drawing Sheets

U.S. PATENT DOCUMENTS

| | | | | |
|---|---|---|---|---|
| 6,412,634 | B1 * | 7/2002 | Telesca et al. | 206/494 |
| 6,688,466 | B2 * | 2/2004 | White et al. | 206/440 |
| 6,790,168 | B1 | 9/2004 | Sand | |
| 6,910,579 | B2 * | 6/2005 | Reinke et al. | 206/494 |
| 7,000,775 | B2 | 2/2006 | Gelardi et al. | |
| D530,223 | S | 10/2006 | Mau et al. | |
| 7,451,874 | B2 * | 11/2008 | Kleinsmith | 206/494 |
| 2004/0166261 | A1 * | 8/2004 | Pockat et al. | 428/34.9 |
| 2005/0263523 | A1 * | 12/2005 | Moss | 220/229 |
| 2005/0263534 | A1 * | 12/2005 | Wu et al. | 221/63 |
| 2006/0091036 | A1 * | 5/2006 | Casella | 206/457 |
| 2006/0131319 | A1 | 6/2006 | McDonald | |
| 2006/0283750 | A1 * | 12/2006 | Villars et al. | 206/494 |

FOREIGN PATENT DOCUMENTS

| | | | |
|---|---|---|---|
| EP | 0898261 | A2 | 2/1999 |
| EP | 1002746 | | 5/2000 |
| EP | 1153838 | B1 | 11/2001 |
| GB | 2256185 | A | 12/1992 |
| WO | WO9629263 | A1 | 9/1996 |
| WO | WO9716075 | A1 | 5/1997 |
| WO | WO9749618 | A1 | 12/1997 |
| WO | WO0102254 | A2 | 1/2001 |
| WO | WO0207665 | A1 | 1/2002 |
| WO | WO02096331 | A2 | 12/2002 |
| WO | WO03050011 | A1 | 6/2003 |
| WO | WO2004080711 | A1 | 9/2004 |
| WO | WO 2006082473 | | 8/2006 |

* cited by examiner

CONTAINER FOR HOLDING A STACK OF PREMOISTENED WIPES

BACKGROUND OF THE INVENTION

Disposable premoistened wipes are marketed and sold in a variety of different forms. The premoistened wipes generally include a substrate that is saturated with a cleaning solution. The substrate can comprise a nonwoven web containing polymeric fibers, pulp fibers, or a mixture of both. The substrate, for instance, may comprise a web that is produced by combining pulp fibers with molten thermoplastic fibers during formation of the web. In another embodiment, the substrate may be formed by hydroentangling pulp fibers with polymer fibers.

The wiping solution applied to the web can vary depending upon the particular application. For instance, premoistened wipes may include baby wipes, disinfectant wipes, cleaning wipes, antimicrobial wipes, and premoistened flushable bath tissue.

Premoistened wipes are packaged and sold in various different types of containers. Baby wipes, for instance, are typically packaged into a rigid plastic canister. The canisters, for instance, may be injection molded and are typically formed in a process separate from the process of producing the wipes themselves. Thus, the canisters are typically formed, stacked together, and then shipped to a location where the wipes are loaded in the canisters.

Many canisters are sold to consumers without any decorative graphics applied to the canisters. When graphics are applied, the graphics are typically applied to an adhesive label that is then later applied to the canister.

In view of the above, a need currently exists for an improved container for wipes, such as premoistened wipes. More particularly, a need exists for a container that can be produced while the container is being packaged with the wipes. A need also exists for a container for wipes that can easily accept graphics for improving the aesthetic appeal of the product or for any other suitable purpose.

SUMMARY

In general, the present disclosure is directed to a container that is particularly well suited to holding and dispensing a stack of wipes, such as premoistened wipes. The container is formed from polymeric sheets and, of particular advantage, can be formed and filled in-line as the stack of wipes is being produced. Also, as will be described in more detail below, the container is constructed such that graphics can be applied directly to the side wall as the container is being fabricated. In this manner, the graphics can cover 100% of the side wall and can include various designs and symbols that can be configured to match the product, match a particular environment, or otherwise improve the aesthetic appeal of the product.

Due to the manner in which the containers are made, the containers can also be formed to have a sleek design. For instance, in one embodiment, the container includes an interior compartment defined by at least one side wall and a bottom member. A top is positioned on the top edge of the side wall. The top has a perimeter and is attached to the side wall such that the perimeter of the top is substantially flush with the side wall. The top can include a lid that is configured to be opened and closed. The lid, when opened, exposes an opening in the top for dispensing wipes from the interior compartment. For instance, in one embodiment, the lid can have a "snap fit" with the container.

In the above embodiment, the at least one side wall may be comprised of a single blank of a polymer sheet having a first end and a second end. The first end and the second end can be fused together to form a single seam. The polymer sheet, for instance, may be made from a polyolefin, such as polyethylene or polypropylene, and can have a thickness of from about 0.1 mm to about 4 mm, such as from about 0.5 mm to about 3 mm. The bottom member, in one embodiment, can also be formed from a polymer sheet and can be fused to the at least one side wall. When the bottom member is fused to the side wall, the bottom member can also be substantially flush with the side wall to produce a container having an overall compact and sleek design.

The top that is positioned on the top edge of the side wall may comprise an injection molded piece. In one embodiment, the top edge of the side wall is constructed so as to define a flange. For instance, in one embodiment, the top edge of the side wall may be folded inwardly upon itself. The top, on the other hand, can include at least one locking member that engages the flange when the top is inserted into the interior compartment. In this manner, the top is securely affixed to the container while remaining flush with the side walls.

Since the side wall is formed from a single blank of a polymer sheet, it is possible according to the present disclosure to apply graphics directly to the side wall prior to forming the container. The graphics can extend from the top edge of the side wall to the bottom member and over an entire perimeter of the side wall. In one embodiment, a stack of wipes can be located into the interior compartment that include a design that is coordinated with the graphics applied to the side wall.

The container can have any suitable shape. For instance, the perimeter of the side wall can generally be in the shape of an oval, a circle, or a rectangle. Of particular advantage, due to the manner in which the container is made, relatively complex shapes can also be used in forming the container.

The present disclosure is also generally directed to a process for forming a container for holding a stack of wipes. The process includes the steps of cutting a continuous polymer strip into individual sheets. The polymer sheets can have a top edge, a bottom edge, a first end, and a second end. Graphics can be applied to the polymer sheets prior to or after the sheets have been cut. For instance, the graphics can be applied to the polymer sheet by printing directly onto the sheet. Any suitable printer may be used to apply the graphics, such as an offset printer or a flexographic printer.

In forming the container, the first end of each polymer sheet is fused to the second end to form a seam. The seam can be located in any suitable location. For instance, in one embodiment, the seam can be located at a sharp radius along the side wall so as to not interfere with any graphics that have been applied to the container.

The bottom edge of the polymer sheet is also fused to a bottom member. For instance, in one embodiment, the bottom member may include a lip that is fused to an interior surface of the side wall along the bottom edge of the side wall. Once the bottom member is applied to the side walls, the container defines an interior compartment for receiving wipes. After the wipes are located into the interior compartment, a top may be placed onto the top edge of the polymer sheet.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
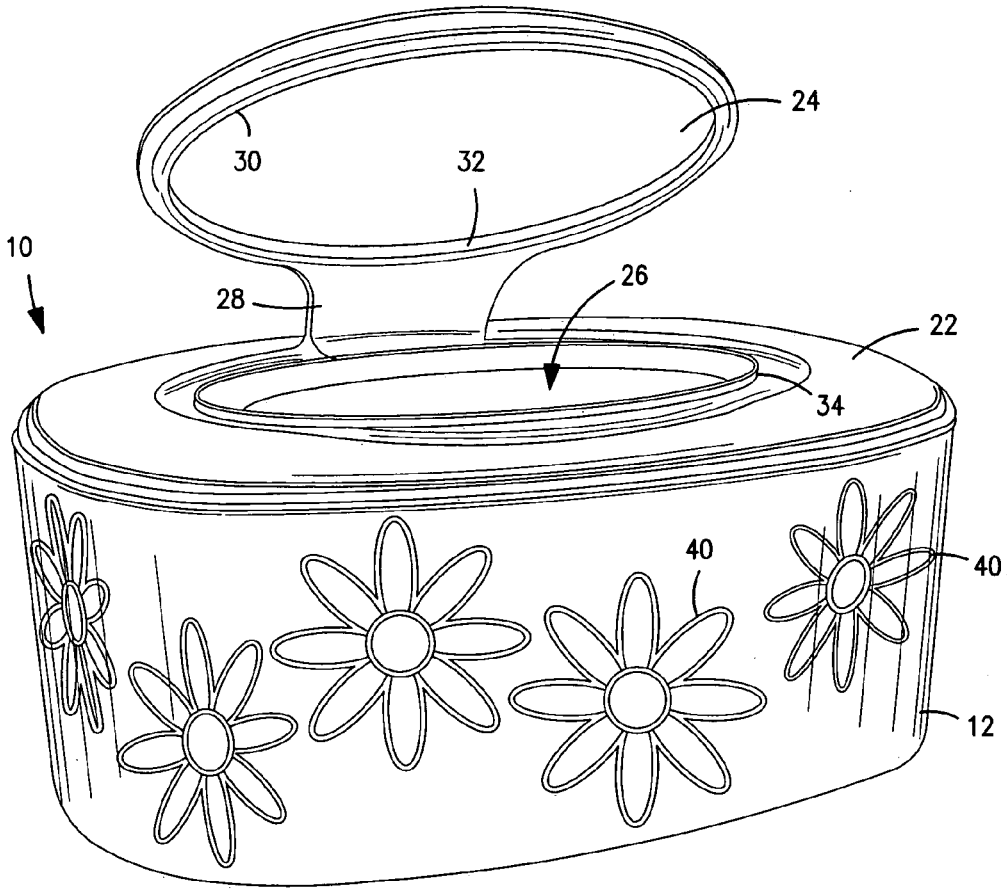
FIG. 1 is a perspective view of one embodiment of a container made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to a container for holding and dispensing wipes. In general, any suitable wipe may be located in the container, such as facial tissues, bath tissues, paper towels, napkins, industrial wipers, and the like. In one particular embodiment, the container is particularly well suited to holding premoistened wipes, such as baby wipes, cleaning wipes, premoistened bath tissue, and the like.

In one embodiment, the container can be formed from a flat sheet of polymer material and can include a separate integrated lid closure. The flat sheet of polymer material, for instance, may be formed around a mandrel and heat sealed to form a single seam. A separate polymer sheet can be used to form a bottom member. The bottom member can also be heat sealed to the side wall forming a liquid tight seal. A top, that may include a lid capable of being opened and closed, can be placed on top of the side wall for forming the container. In one embodiment, the top can have an integrated closure and dispensing design and can fit on the top edges of the side wall for also forming a liquid tight seal.

As will be described in greater detail below, the container of the present disclosure provides various advantages and benefits. For instance, in a relatively simple printing procedure, the container is capable of accepting full color, high quality graphics that can cover 100% of the surface area of the side wall. For example, the side walls can be printed in their flat state and then formed into the containers.

As also will be described in greater detail below, the containers of the present disclosure can also be formed and filled in-line. Thus, the containers do not need to be formed at a separate facility and then sent to a package filling operation. Instead, the containers can be formed and filled all in a single process.

Also of particular advantage is that the containers can be formed having any suitable shape. For instance, the containers can be formed so as to have a sleek and aesthetically appealing design.

Figure 2:
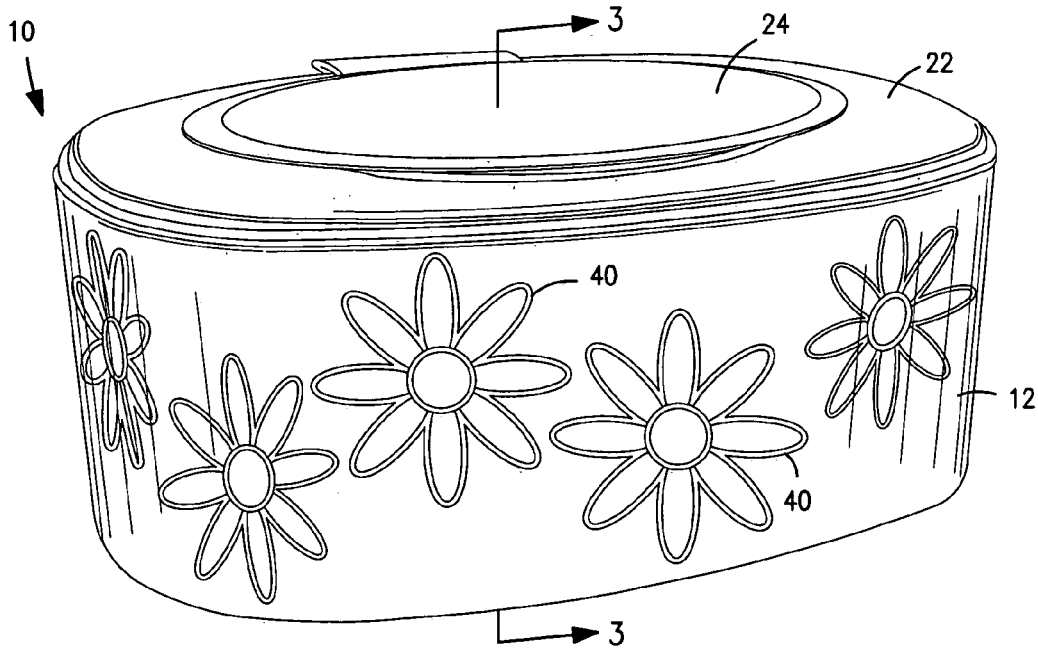
FIG. 2 is another perspective view of the container illustrated in FIG. 1.
Figure 3:
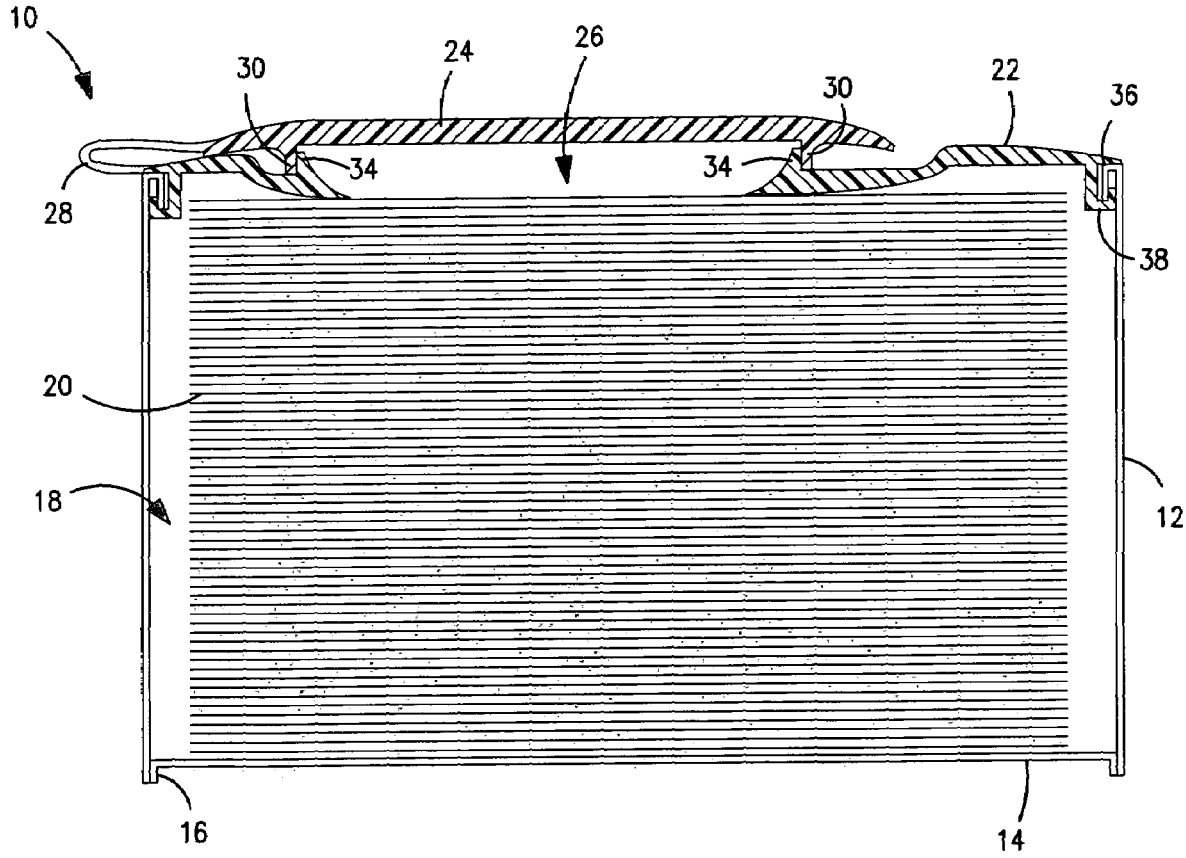
FIG. 3 is a cross sectional view of the container illustrated in FIG. 1.

For example, referring to FIGS. 1, 2 and 3, one embodiment of a container 10 made in accordance with the present disclosure is illustrated. It should be understood, however, that containers having numerous different configurations may be formed according to the present disclosure and that the embodiment illustrated in FIGS. 1 through 3 represents merely one embodiment. In this embodiment, for instance, the container has an overall oval shape and design.

As shown, the container 10 includes a side wall 12 that can be made from a single sheet of polymeric material. As particularly shown in FIG. 3, the side wall 12 is attached to a bottom member 14. The bottom member 14 can also be made from a polymeric sheet and thus can be fused to the side wall 12. For instance, the bottom member 14 can be thermally bonded or ultrasonically bonded to the side wall 12.

As shown particularly in FIG. 3, in one embodiment, the bottom member 14 can include a lip 16. The lip 16 is fused to the side wall 12. In the embodiment illustrated in FIG. 3, the lip 16 faces downwards which creates a concave bottom surface. Alternatively, however, the lip 16 may face upwards providing for a flat bottom surface.

By attaching the bottom member 14 to the side wall 12 as illustrated in FIG. 3, the bottom member is bonded to an inside surface of the side wall. Thus, the bottom member 14 does not protrude outward from the side wall and, instead, is flush with the container wall.

As shown particularly in FIG. 3, the side wall 12 and the bottom member 14 form an interior compartment 18 that is designed to hold various materials. For instance, in one embodiment, the interior compartment can be loaded with a stack of wipes 20. The wipes 20 may be stacked one on top of another or may be interfolded together. In one embodiment, the wipes 20 comprise premoistened wipes.

The container 10 also includes a top 22. The top 22 can also be made from a polymeric material and can be, for instance, injection molded. In order to dispense wipes, the top 22 can include a lid 24. The lid 24 can be configured to open and close in order to expose an opening 26 for dispensing wipes from the interior compartment 18. As shown in the figures, the lid 24 can include a hinge member 28 that maintains the lid attached to the container when the lid is open.

The lid 24 can form a snap fit with the top 22 when closed. In this regard, any suitable arrangement may be used in order to maintain the lid in a closed position. For instance, in one embodiment, a pressure sensitive adhesive may be used to maintain the lid closed when desired. Alternatively, any suitable mechanical interlocking structure may be used.

For example, in FIGS. 1 through 3, the lid 24 includes a ridge 30 that may include one or more locking elements 32. On the top 22 surrounding the opening 26, on the other hand, the container can include a rim 34 that can define one or more grooves having a size and shape configured to receive the one or more locking elements 32. It should be understood, however, that the above described embodiment is provided for exemplary purposes only and any suitable interlocking mechanism may be used.

As shown in FIGS. 1 through 3, the top 22 is attached to the top edges of the side wall 12. Of particular advantage, the top is connected to the side walls such that the top is substantially flush with the side walls. In this manner, the container takes on a sleek appearance.

The top 22 can be connected to the side walls using any suitable arrangement. In the embodiment illustrated in FIG. 3, for instance, the side wall 12 defines a flange 36. The flange 36 can be formed by folding the top edges of the side wall 12 inwardly onto itself. The top 22, on the other hand, can include at least one corresponding locking member 38 that is designed to intercept and engage the flange 36. For example, as shown in the embodiment in FIG. 3, the top 22 includes a locking member 38 that extends around the perimeter of the top. In this embodiment, the locking member 38 has the shape of a "J" or hook that fits within the flange 36. In this manner, when the top 22 is inserted into the interior compartment 18 of the container 10, the locking member 38 engages the flange 36 which holds the top in place and prevents the top from being removed.

If desired, the attachment between the top 22 and the side wall 12 can be fluid tight. In fact, in one embodiment, if desired, a gasket material may be placed within the flange 36 or within the locking member 38 in order to ensure that a fluid tight seal is formed. The gasket material can be made from any suitable material, such as a thermoplastic elastomer (TPE).

As shown in FIGS. 1 and 2, the container 10, if desired, can include various graphics applied to the side wall 12. In this embodiment, for instance, the side wall 12 includes a plurality of flowers 40. Of particular advantage, since the side wall 12 can be formed from a flat sheet of polymeric material, the graphics can be applied directly to the side wall 12 instead of having to apply a label to the side wall. For instance, the graphics can be printed onto the side wall 12 prior to forming the side wall into a particular shape. In general, any suitable printing process may be used. For instance, in one embodiment, a flexographic printer or an offset printer may be used to apply the graphics.

Also of advantage, the graphics can be applied over the entire surface area of the side wall 12. In this regard, the graphics can extend from the bottom edge of the side wall to the top edge. For example, in the embodiment illustrated in FIGS. 1 and 2, the flowers 40 may be surrounded by various background colors that extend from the bottom edge of the side wall to the top edge. In addition, the graphics can extend around the entire perimeter of the side wall 12.

In one embodiment, the graphics applied to the side wall 12 can be selected so as to coordinate with other design elements. For instance, the graphics applied to the side wall 12 can be designed to match graphics or embossments applied to any wipes enclosed within the container. In an alternative embodiment, the container 10 can be packaged with other containers that contain other wiping products. For instance, the container 10 as shown in FIG. 1 may contain premoistened wipes and can be packaged with facial tissues contained within a paperboard container. In this embodiment, the graphics applied to the tissue box can be coordinated with the graphics that are applied to the container 10 as shown in FIG. 1.

In addition to decorative graphics, such as flowers 40, it should be understood that any suitable graphics can be applied to the side wall 12 depending upon the particular application. For instance, in other embodiments, ingredient lists, instructions, trademarks, and the like can be applied to the side wall 12.

In one embodiment, the side wall 12 can be made from a translucent or transparent polymeric material. Graphics can be applied to the transparent or translucent material to further enhance the aesthetic appeal of the product.

Figure 4:
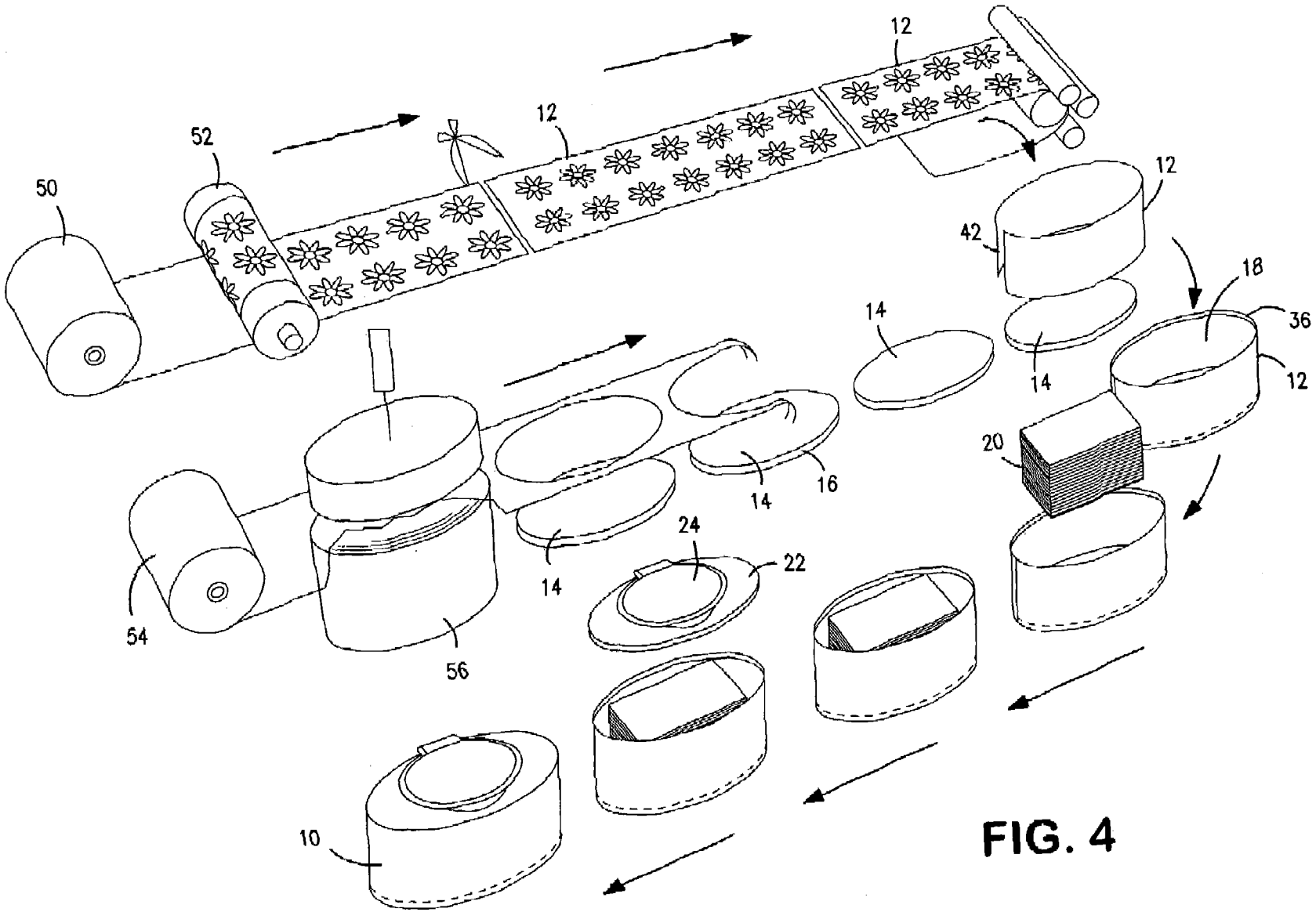
FIG. 4 is a process diagram illustrating one embodiment of a process for forming containers in accordance with the present disclosure.

The container 10 as shown in FIGS. 1 through 3 can be formed and loaded with a stack of wipes all in one single process as shown in FIG. 4. Thus, the containers do not have to be produced at a separate facility and shipped to where packaging occurs. Thus, in one embodiment, the containers do not have to nest with respect to one another in order to maximize shipping efficiencies of an empty container. Instead, as shown in FIG. 3, the container 10 can be configured such that the side wall 12 is substantially vertical with respect to a horizontal upon which the container rests. In this embodiment, the containers are made so as to have a non-nesting configuration.

By constructing a container having a relatively vertical side wall 12 as shown in FIG. 3, various advantages and benefits may be realized. For instance, although the containers 10 will not stack together, once loaded with a stack of wipes and packaged together, the containers will rest securely adjacent one another for maximizing packing efficiency of the loaded container.

In addition, having a vertical side wall 12 may provide a better display for the graphics applied to the side wall in order to maximize the aesthetic qualities of the graphics.

Referring to FIG. 4, one embodiment of a process for forming the container 10 as shown in FIGS. 1 through 3 is illustrated. As shown, a roll of polymeric material 50 is unwound and cut into sheets to form the side wall 12. In this embodiment, as the polymeric material 50 is unwound, the flowers 40 and any background colors are applied to the material using a printer 52. After the graphics are applied to the polymeric material, the polymeric material is cut into individual sheets which form side wall 12. It should be understood, however, that the graphics can be applied to the side wall 12 after the sheets have been cut. Of particular advantage, the graphics are applied to the side wall 12 while the side wall is in a flat state.

The side wall 12 can be formed from any suitable polymeric material. More particularly, the side wall 12 can be made from a thermoplastic polymer, such as a polyolefin. Particular examples of polymers that may be used include polypropylene, polyethylene, and copolymers thereof. In general, the polymeric materials should have a thickness sufficient to create a semi-rigid container. In this regard, the thickness of the polymeric material can be from about 0.1 mm to about 4 mm.

The color of the polymeric material can also vary depending upon the particular application. For instance, in one embodiment, the polymeric material can have a white color that may be well suited to displaying the graphics that are applied to the material. Alternatively, as described above, the material can be transparent or translucent. In still another embodiment, the polymeric material may have a non-white color that may be used to accent the graphics that are later applied to the material.

Once the side wall 12 is cut and printed, the side wall is then formed into any desired shape. For instance, in FIG. 4, the side wall is given an oval shape. In this embodiment, for instance, the polymer sheet can be wrapped around a forming mandrel and fused together to form a single seam. The ends of the polymeric sheet can be sealed together using any suitable energy source. For instance, in one embodiment, the ends can be heat sealed together or can be ultrasonically sealed together.

According to the present disclosure, a seam 42 that is formed on the side wall 12 can be positioned at any suitable location. For instance, if desired, the seam 42 can be placed along the side wall 12 at the sharpest radius of the shape so that the seam 42 does not interfere with the graphics that are applied to the side wall.

As shown in FIG. 4, a second roll of polymeric material 54 is also unwound and fed into the process. The second roll of polymeric material 54 can be used to form the bottom member 14 of the container 10. As shown, the polymeric material 54 is unwound and fed to a die cutting apparatus 56. The die cutting apparatus 56 can be configured not only to cut the polymeric material to form the bottom member but also can be used to mold the bottom member into any particular shape. For example, as shown, the bottom member can be formed to have a lip 16 that is later used to seal the bottom member to the side wall 12.

If desired, any suitable graphics can also be applied to the bottom member 14. For instance, a manufacturer may want to apply ingredient lists, trademark information, or any other government required notice to the bottom member 14 so as to not interfere with the aesthetic graphics applied to the side wall 12.

The polymeric material 54 that is used to form the bottom member 14 can be any suitable polymeric material as described above. In one embodiment, for instance, the polymeric material used to form the roll 54 can be the same material that is used to form the roll 50.

Once the bottom member 14 is formed, the bottom member 14 is fused to the bottom edges of the side wall 12. The bottom member can be attached to the side wall using adhesives or can be thermally or ultrasonically bonded to the side wall. In one embodiment, the bottom member 14 can be fused to the side wall 12 at the same time the seam 42 is formed in the side wall. Alternatively, the bottom member can be attached to the side wall in a separate step. Once the bottom member 14 is attached to the side wall 12, an interior compartment 18 is defined that is configured to receive a stack of wipes 20.

Figure 5:
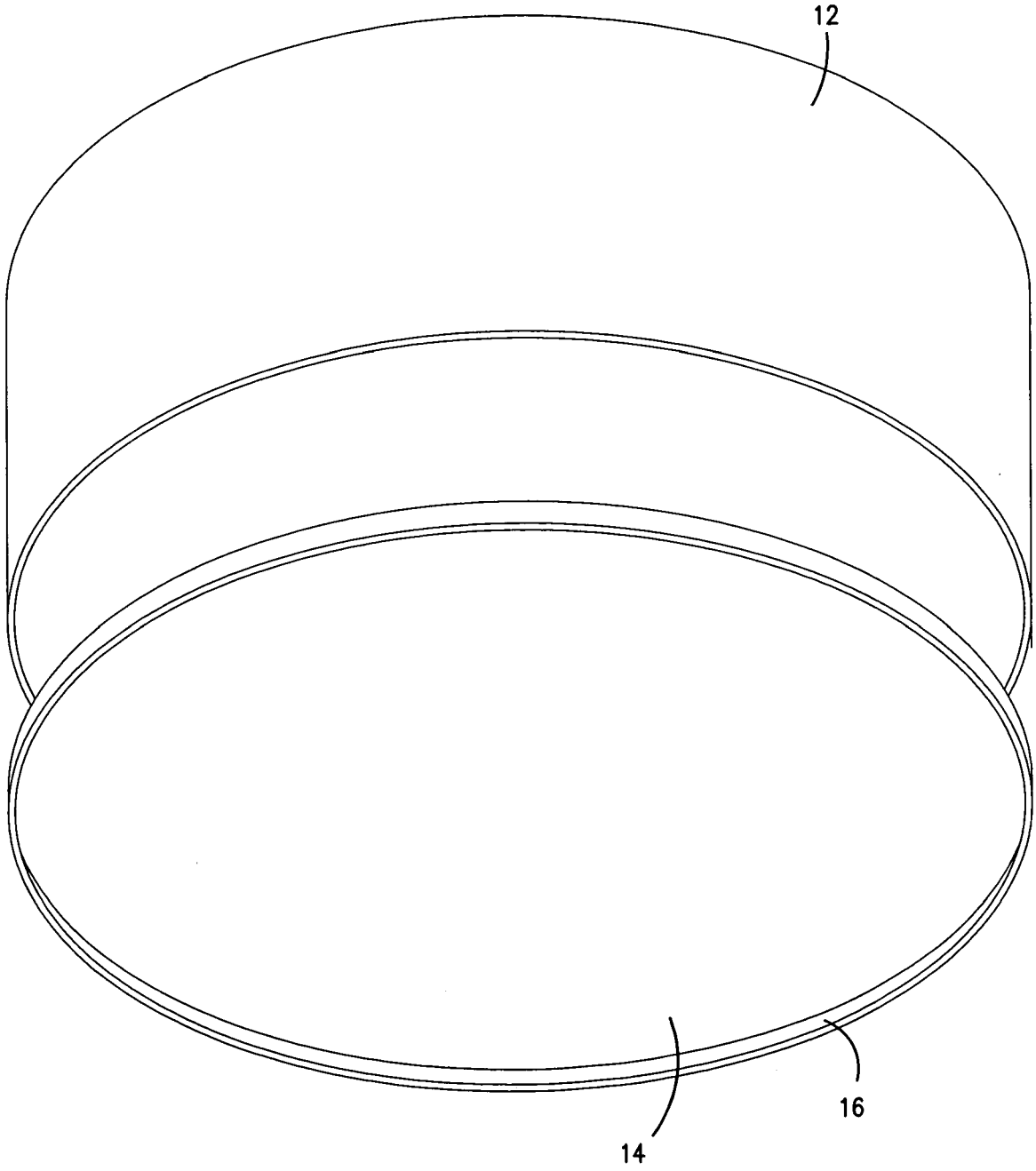
FIG. 5 is a perspective view illustrating the attachment of a bottom member to a side wall in forming a container according to the present disclosure.

Referring to FIG. 5, an enlarged view of the bottom member 14 and the side wall 12 are shown. As illustrated, the bottom member 14 includes a lip 16 that is used to bond the bottom member to the side wall. The bottom member is fitted inside the side wall 12 so that the lip 16 can bond to the interior surface of the side wall. Of particular advantage, a water-tight seal can form between the bottom member and the side wall.

As shown in FIG. 4, in one embodiment, after the bottom member 14 is attached to the side wall 12, the flange 36 can be formed in the top edge of the side wall. The flange 36 can be formed by folding the top edge inward upon itself. The flange 36 can be formed into the side wall for locking engagement with a top.

Figure 6:
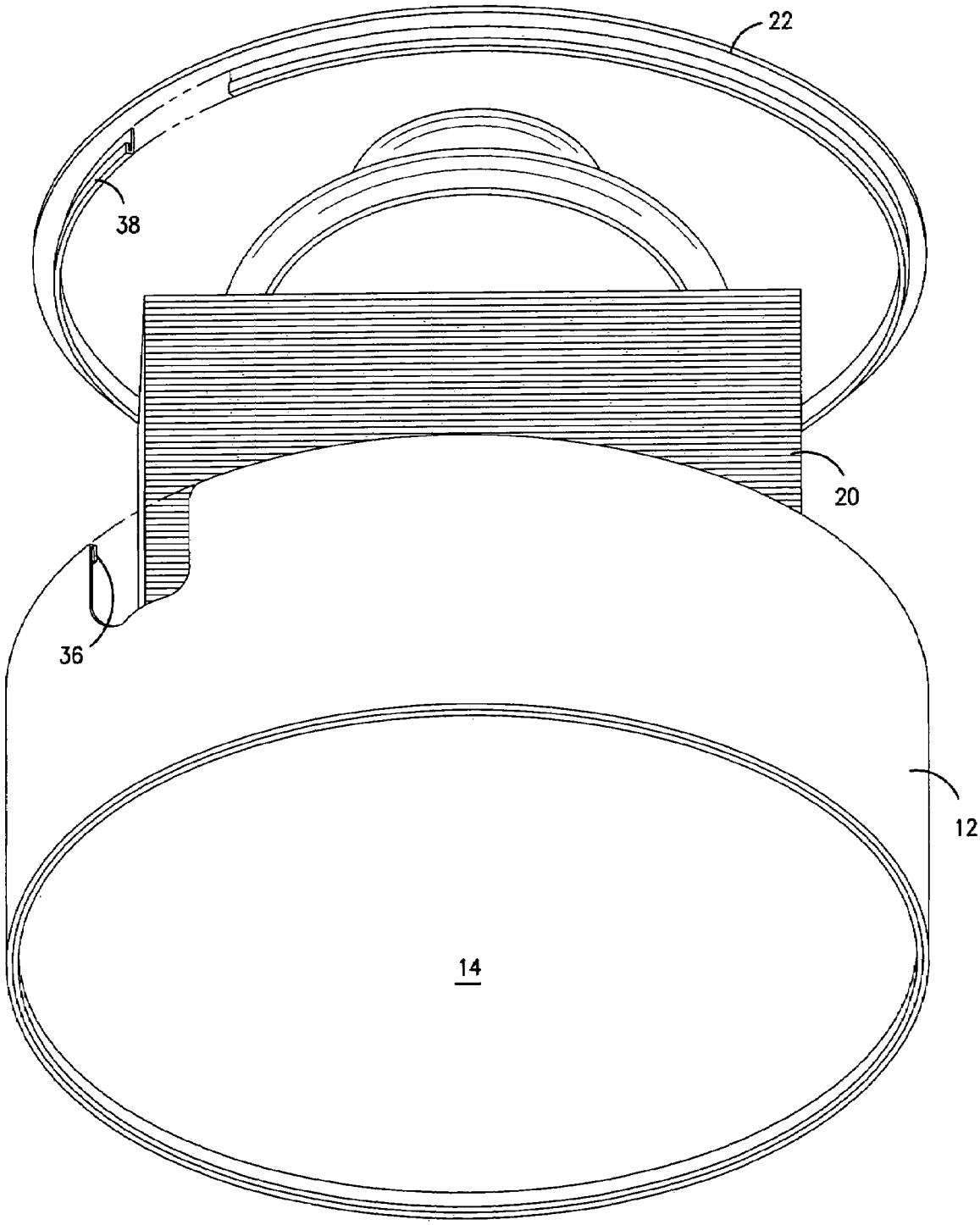
FIG. 6 is a perspective view with cutaway portions illustrating the step of loading the container with a stack of wipes and attaching a top to the container.

As shown in FIG. 4 and in FIG. 6, once the flange 36 is formed in the side wall 12, a stack of wipes 20 is loaded into the container and the top 22 is secured to the top edges of the side wall. The top 22 can be formed through an injection molded process and can be made from any suitable polymeric material. As shown particularly in FIG. 6, the top 22 can be formed so as to have at least one locking member 38 that is designed to engage the flange 36. Thus, when the top 22 is inserted into the interior compartment formed by the side wall 12, the locking member 38 engages and forms a secure interlocking relationship with the flange 36. Once the top is attached to the side wall 12, the container 10 is completed as shown in FIG. 4.

As described above, the top 22 can be formed through an injection molded process. It should be understood, that in other embodiments, the side wall and/or the bottom member can also be formed through injection molding prior to being connected to the other parts of the container.

Of particular advantage, the container 10 can be formed and loaded with the wipes all in a single process step. In FIG. 4, a generally linear process is illustrated. Alternatively, however, the container can be formed and loaded with the wipes on a rotating carousel in which one process step is completed at a particular position on the radius of the carousel.

Figure 7:
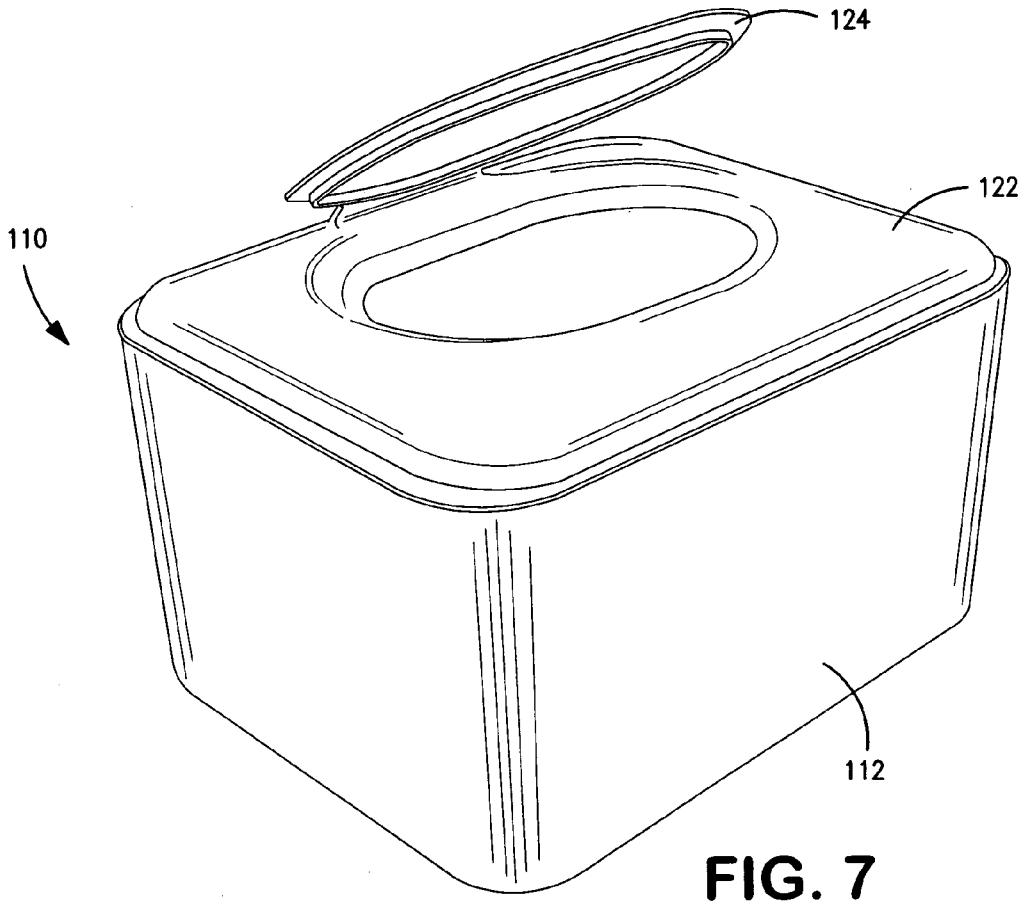
FIG. 7 is a perspective view of another embodiment of a container made in accordance with the present disclosure.

In the embodiments illustrated in FIGS. 1 through 6, a container 10 is formed that generally has an oval-like shape. It should be understood, however, that the side wall 12 can be molded so as to have any particular desired shape. For instance, referring to FIG. 7, an alternative embodiment of a container 110 made in accordance with the present disclosure is illustrated. As shown, the container 110 includes a side wall 112 attached to a top 122 that defines a lid 124. In the embodiment illustrated in FIG. 7, the container has a generally square shape.

Figure 8:
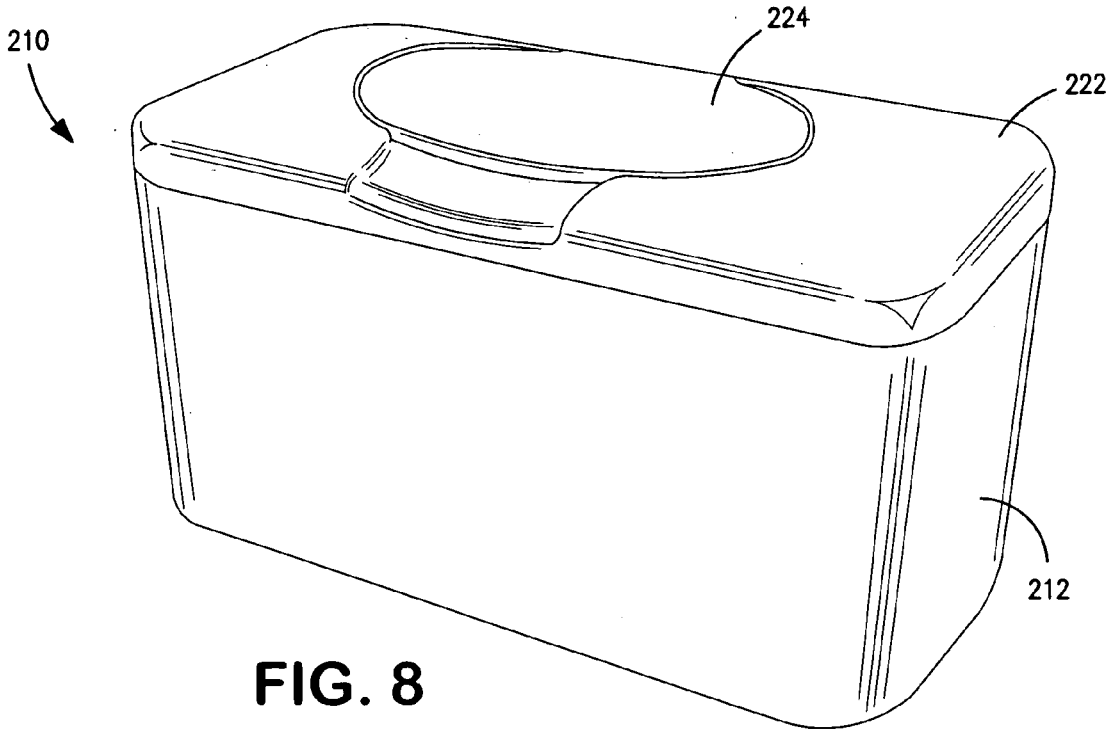
FIG. 8 is a perspective view of still another embodiment of a container made in accordance with the present disclosure.

Referring to FIG. 8, still another embodiment of a container 210 made in accordance with the present disclosure is illustrated. The container 210 includes a side wall 212 and a top 222 defining a lid 224. In the embodiment illustrated in FIG. 8, the container generally has a rectangular shape.

In addition to ovals, squares and rectangles, it should be understood that various other shapes can be formed. For instance, relatively complex shapes can also be constructed.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for forming a container for holding a stack of wipes comprising:

cutting a continuous polymer strip into individual sheets, the polymer sheets having a top edge, a bottom edge, a first end, and a second end;

applying graphics to the polymer sheets;

fusing the first end of each polymer sheet to the second end to form a seam;

fusing the bottom edge of each polymer sheet to a bottom member, the polymer sheet and the bottom member defining an interior compartment; and placing a top onto the top edge of each polymer sheet.

2. A process as defined in claim 1, wherein the graphics are applied to the polymer sheets prior to cutting the polymer strip into individual sheets.

3. A process as defined in claim 1, wherein the graphics are applied to the polymer sheets after the sheets are cut from the polymer strip.

4. A process as defined in claim 1, further comprising the steps of forming a flange along the top edge of the polymer sheets, each top including at least one locking member that engages the flange when the top is inserted into the interior compartment.

5. A process as defined in claim 1, wherein the top is formed through injection molding and includes a lid that is configured to be opened and closed, the lid, when opened, exposing an opening in the top for dispensing wipes from the interior compartment.

6. A process as defined in claim 1, wherein the graphics are applied to the polymer sheets using a flexographic printer or an offset printer.

7. A process as defined in claim 1, wherein the polymer strip is unwound from a roll, the polymer strip comprising a polyolefin having a thickness of from about 0.1 mm to about 4 mm.

8. A process as defined in claim 1, further comprising the step of cutting a second continuous polymer strip into individual sheets to form the bottom members.

9. A process as defined in claim 1, wherein the top includes a perimeter and wherein the top is inserted into the interior compartment such that the perimeter of the top is substantially flush with the polymer sheet.

10. A process as defined in claim 1, further comprising the step of inserting a stack of wipes into the interior compartment prior to placing the top onto the top edge of each polymer sheet.

11. A process as defined in claim 1, wherein each polymer sheet is substantially vertical with respect to the bottom member when fused to the bottom member, each container generally having a non-nesting configuration with respect to an opposing container.

12. A container for a stack of wipes comprising:

an interior compartment defined by a single side wall and a bottom member, the side wall having a height and a top edge, the side wall comprising a sheet of polymeric material;

a separate top positioned on the top edge of the side wall, the top including a lid that is configured to be opened and closed, the lid, when opened, exposing an opening in the top for dispensing wipes from the interior compartment; and wherein the single side wall is comprised of a single blank of the sheet of polymeric material having a first end and a second end, the first end and the second end having been fused together to form a single seam, and wherein graphics have been preapplied directly to the sheet of polymeric material prior to forming the single seam.

13. A container as defined in claim 12, wherein the graphics applied to the side wall extend substantially over the entire height of the side wall.

14. A container as defined in claim 12, wherein the side wall has a perimeter and wherein the graphics extend around substantially the entire perimeter of the side wall.

15. A container as defined in claim 12, wherein the graphics are printed onto the sheet of polymeric material.

16. A container as defined in claim 15, wherein the graphics have been applied to the side wall using a flexographic printer or an offset printer.

17. A container as defined in claim 12, wherein the top edge of the side wall defines a flange and wherein the top includes at least one locking member that engages the flange when the top is inserted into the interior compartment, the top having a perimeter and being attached to the side wall such that the perimeter of the top is substantially flush with the side wall.

18. A container as defined in claim 12, wherein the at least one side wall is substantially vertical with respect to a horizontal upon which the container rests such that the interior compartment has a substantially non-nesting configuration with respect to an interior compartment of a similar container.

19. A container as defined in claim 12, further comprising a stack of wipes located in the interior compartment, the wipes including a design that is coordinated with the graphics printed onto the side wall.

20. A container as defined in claim 12, wherein the seam is located at a sharpest radius of the side wall.

21. A container as defined in claim 12, wherein the bottom member is separately attached to the side wall.

* * * * *